US007294062B2

(12) United States Patent
Ting

(10) Patent No.: US 7,294,062 B2
(45) Date of Patent: Nov. 13, 2007

(54) INDOOR PUTTING GAME DEVICE

(76) Inventor: James Ting, 7F, No. 356, Fu Hsing N. Rd., Taipei (TW)

( * ) Notice: Subject to any disclaimer, the term of this patent is extended or adjusted under 35 U.S.C. 154(b) by 0 days.

(21) Appl. No.: 11/356,982

(22) Filed: Feb. 21, 2006

(65) Prior Publication Data

US 2007/0197306 A1 Aug. 23, 2007

(51) Int. Cl.
*A63B 69/36* (2006.01)

(52) U.S. Cl. ..... 473/162; 473/160

(58) Field of Classification Search ..... 473/157–163, 473/181, 185, 180

See application file for complete search history.

(56) References Cited

U.S. PATENT DOCUMENTS

| | | | | | |
|---|---|---|---|---|---|
| 1,952,187 | A * | 3/1934 | Ripley | 473/158 |
| 2,057,504 | A * | 10/1936 | Schafer | 473/162 |
| 3,727,918 | A * | 4/1973 | Zawacki | 473/159 |
| 3,990,573 | A * | 11/1976 | Cross | 190/115 |
| 4,017,084 | A * | 4/1977 | Jeffery | 473/162 |
| 4,691,923 | A * | 9/1987 | Schwartz | 473/185 |
| 5,538,253 | A * | 7/1996 | Foster | 273/108.21 |
| 5,720,667 | A * | 2/1998 | Tu | 473/162 |
| 5,860,648 | A * | 1/1999 | Petermeier et al. | 273/108.2 |
| 6,849,000 | B2 * | 2/2005 | Chen | 473/161 |
| 2003/0096658 | A1 * | 5/2003 | Elliott | 473/162 |

FOREIGN PATENT DOCUMENTS

WO WO 94/08667 * 4/1994

* cited by examiner

*Primary Examiner*—Mark S Graham
(74) *Attorney, Agent, or Firm*—Rosenberg, Klein & Lee

(57) ABSTRACT

An indoor putting game device includes a main body, a plurality of goal boards with different patterns and ball holes of different numbers optionally selected to be mounted on the main body, and a flexible ball course member wound on a shaft in the main body possible to be pulled out from a front end of the main body. The main body has the shaft for winding the ball course member while not used or releasing it out for use. The goal board can be adjusted in its inclination by optionally inserting position pins in a pair of pinholes in two sidewalls of the main body. So the device can be used in playing putting game in various modes, boosting users' interest in playing and achieving game and exercise effect.

3 Claims, 6 Drawing Sheets

INDOOR PUTTING GAME DEVICE

BACKGROUND OF THE INVENTION

1. Field of the Invention

This invention relates to an indoor putting game device, particularly to one provided with a flexible ball course member easily wound on a shaft, and a plurality of various goal boards to be optionally used and possible to be adjusted in the inclined angle at the same time to intrigue more interests in playing a golf putting game, boosting its usable value and exercise effect.

2. Description of the Prior Art

Owing to ever growing consumption by people in the present day, calories and cholesterol taken in our body have been heightened a lot, and a large number of people are engaging in more sedentary work in cooled rooms, sitting before computers. Thus people are exposed to stress every day because of intensive work conditions, and understand that it is important to exercise almost every day to keep their body fit by some means.

As for taking exercise, they may go to parks, outdoor stadiums, leisure clubs, gymnasiums, etc. There is considerable expense if they were to go to fitness clubs or gymnasiums, and though parks or outdoor gymnasiums are used for free, they may be limited by the weather conditions. So many kinds of simple exercise devices have been developed and sold on the market for people to use indoors.

One of the simple devices is an indoor golf putting game device, which includes a main body provided with ball holes, a sloped board located in front of the main body, and a ball course member connected with the sloped board, so a user may play putting a ball on the putting game device with the slope functioning as a virtual green for a ball to roll thereon to fall into a ball hole, obtaining golf putting technique and exercising at the same time.

However, the conventional golf putting game device has been found to have the following disadvantages:

3. Though its ball course member can be collapsed, its collapsing operation is not so convenient, still taking much space after being collapsed.
4. Its structure only supplies ball holes for a ball to roll over to fall into, which is too monotonous for exercising and playing a putting game.

SUMMARY OF THE INVENTION

The feature of the invention is a shaft provided in a main body and fixed with a handle outside of the main body for winding a flexible ball course member while not used and releasing out for use, and a plurality of goal boards with different patterns with ball holes of different numbers optionally mounted on the main body so that a user can play different modes of playing putting game. Further the goal board can be adjusted in its inclination by means of position pins optionally inserted in a pair of pin holes formed in two sidewalls of the main body for a golf ball to roll thereon so that a user can play different modes of putting game.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
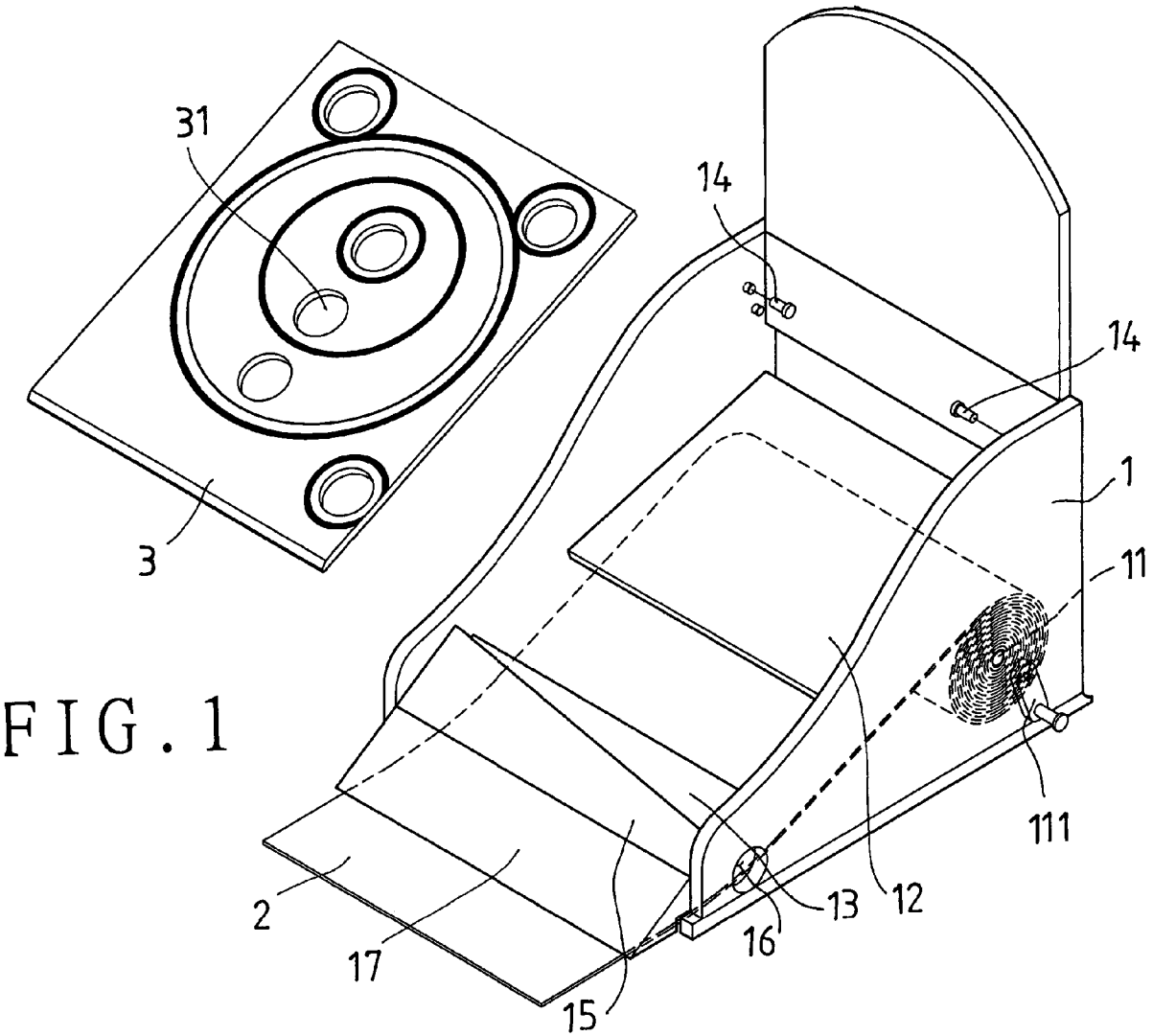
FIG. 1 is a perspective view of an indoor putting game device in the present invention.

A preferred embodiment of an indoor putting game device in the present invention, as shown in FIG. 1, includes a main body 1, a flexible ball course member 2, and a plurality of goal boards 3 as main components combined together.

The main body 1 is provided with shaft 11 laterally in its interior, a stop board 12 located between two sidewalls and extending forward to incline down from a vertical wall of the main body 1, a rest board 13 laterally located between the two sidewalls near a front end for the front end of a goal board 3 to rest thereon, a position pin 14 for supporting an upper end of the goal board 3 fitting in one of the plural pin holes formed in two sidewalls of the main body 1 so as to adjust optionally the inclined angle of the goal board 3, a first sloped board 15 located between the two sidewalls laterally in the front portion and extending forward and inclined down from the front end of the goal board 3 and having its lower end on an exit 16 formed in the lower end of the main body 1. Further, a second sloped board 17 is provided laterally to extend down forward from the first sloped board 15.

Figure 4:
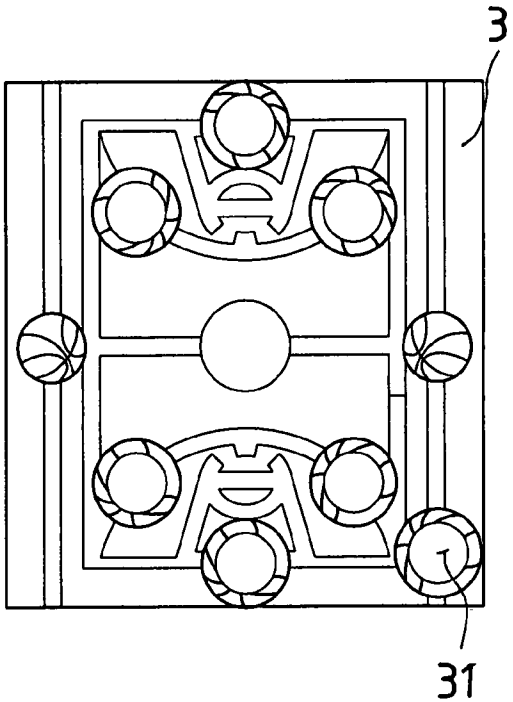
FIG. 4 is a front view of a third goal board in the present invention.
Figure 3:
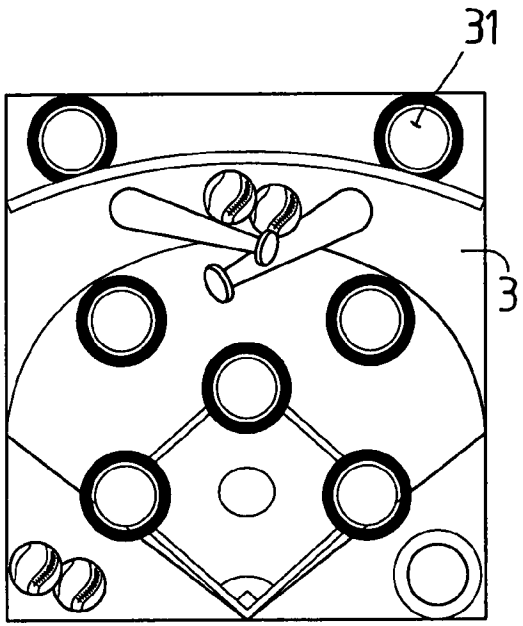
FIG. 3 is a front view a second goal board in the present invention.
Figure 2:
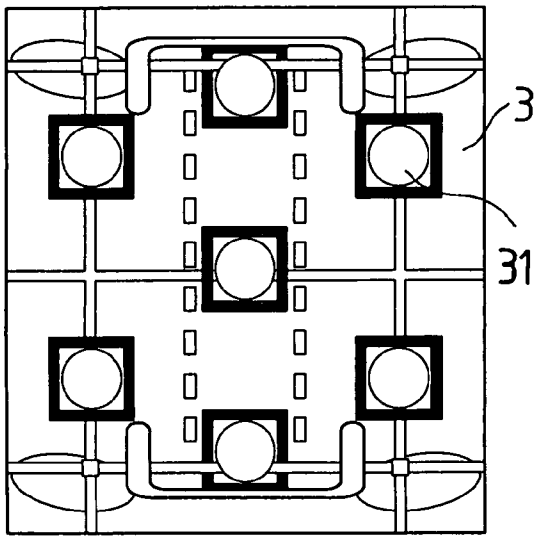
FIG. 2 is a front view of a first goal board in the present invention.
Figure 5:
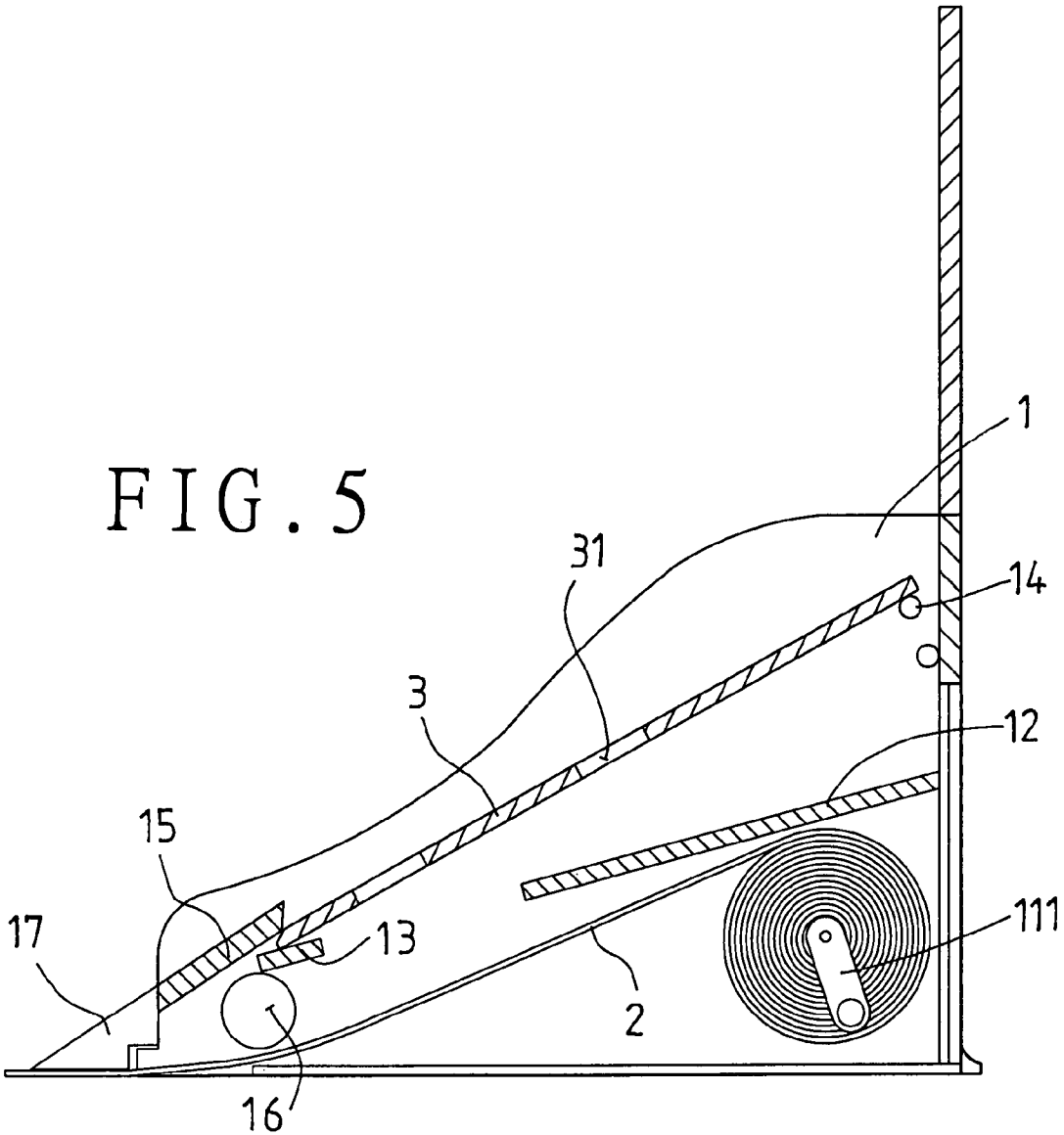
FIG. 5 is a side cross-sectional view of the indoor putting game device in the present invention.
Figure 6:
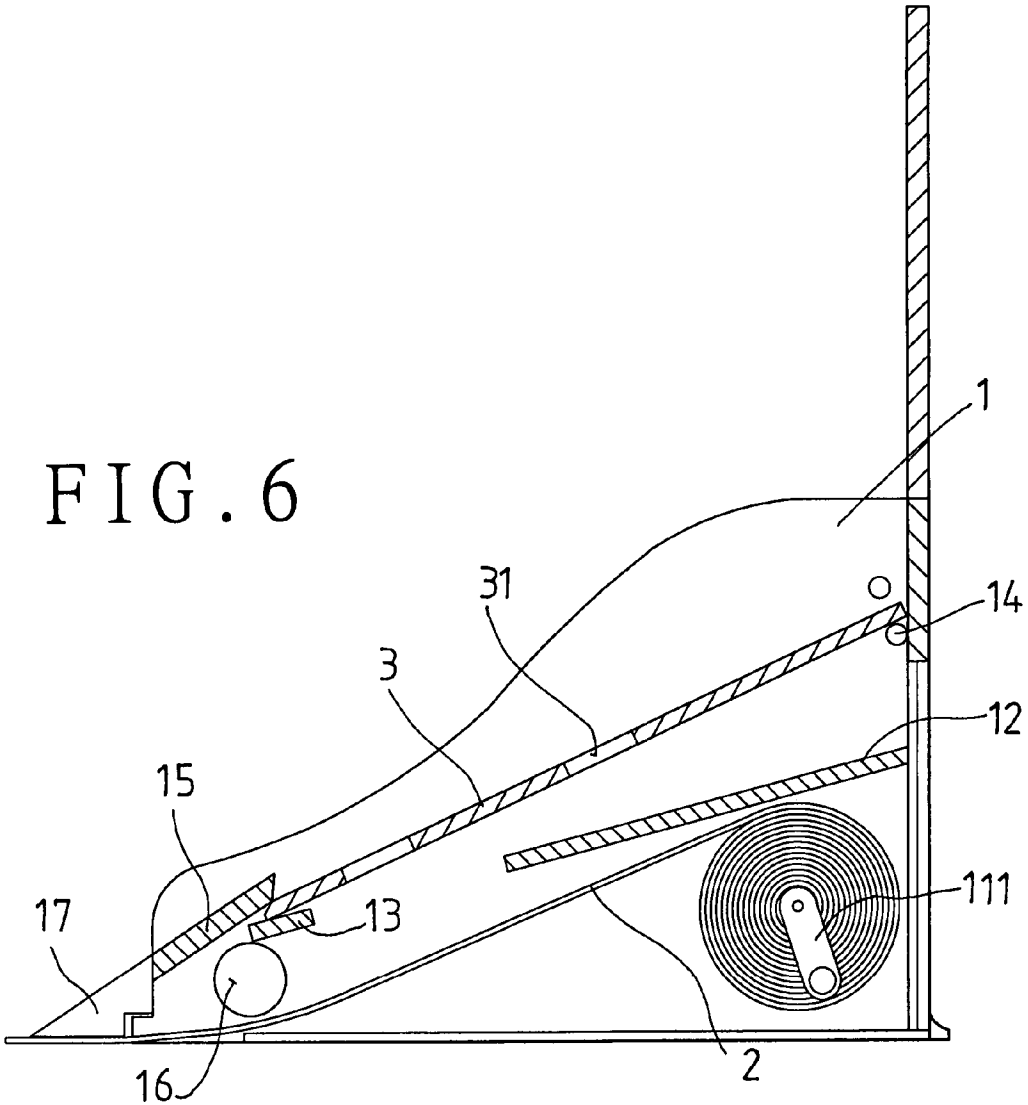
FIG. 6 is a side cross-sectional view of the goal board adjusted in a first inclined angle in the present invention.
Figure 7:
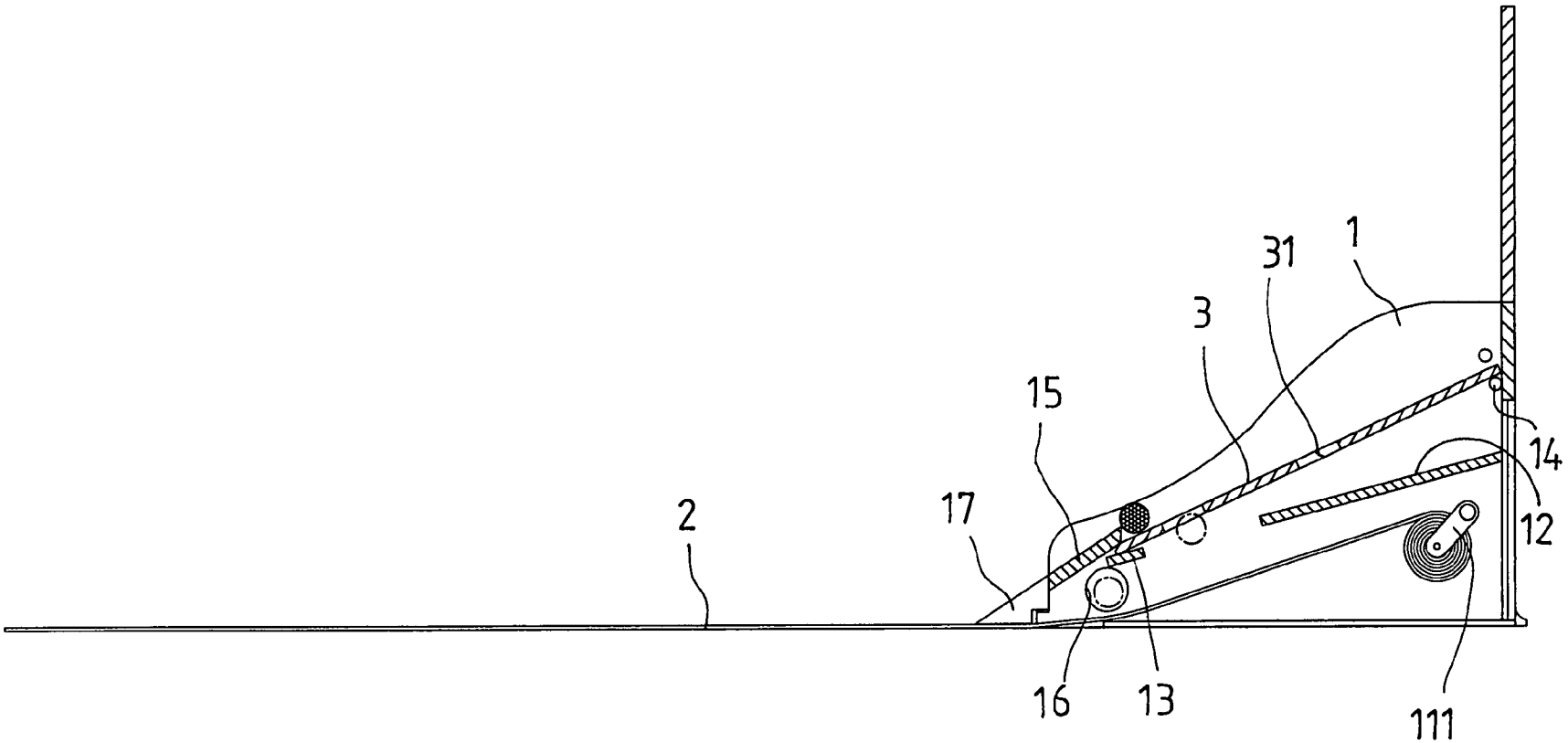
FIG. 7 is a side cross-sectional view of the goal board adjusted in a second inclined angle in the present invention; and, FIG. 8 is an upper view of the indoor putting game device in a using condition in the present invention.
Figure 8:
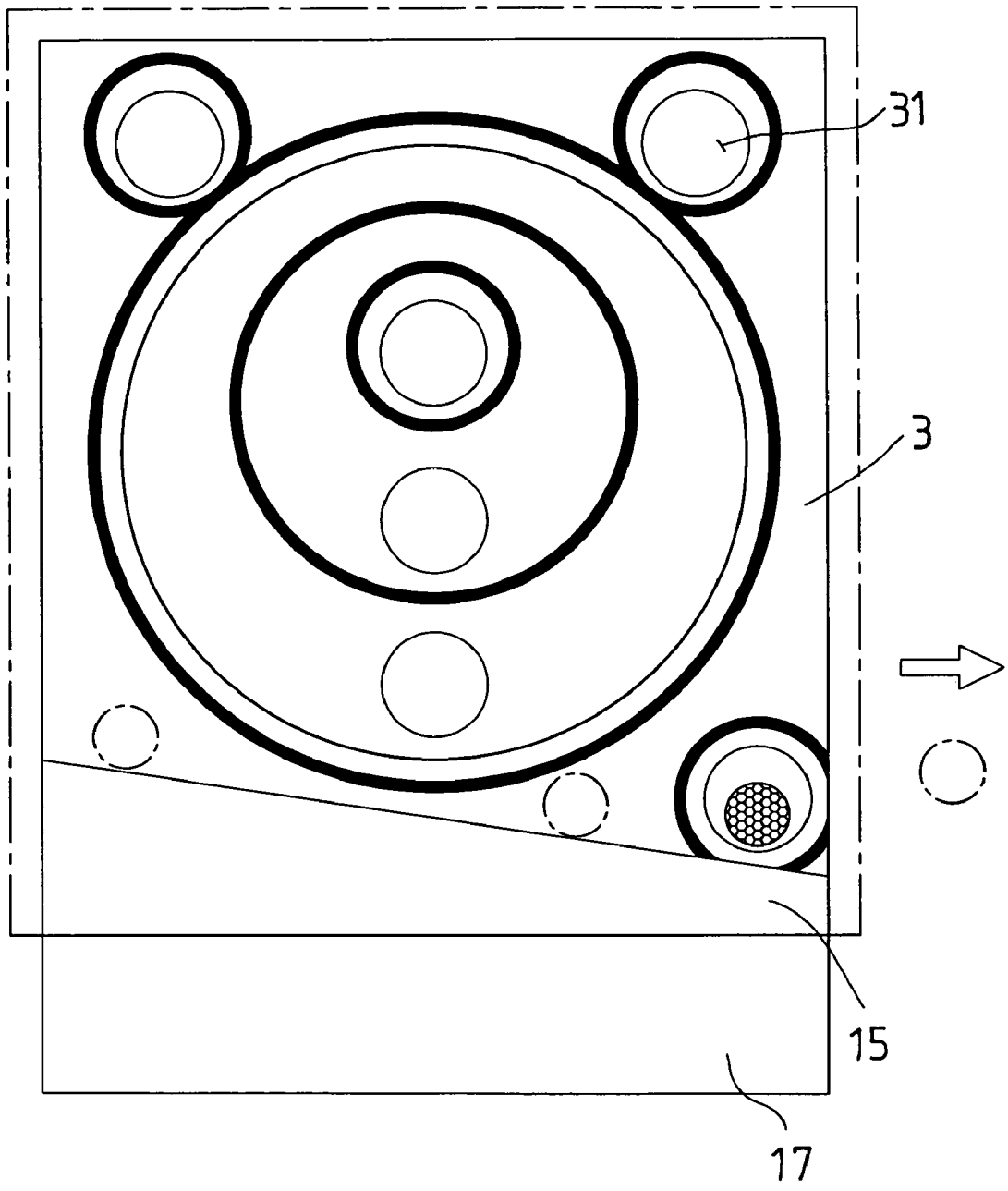

The plural goal boards 3, as shown in FIGS. 2, 3 and 4, can be used optionally, chosen by a user according to the playing manner the user wants, as the goal boards 3 have different patterns and ball holes for playing in various ways.

Playing the putting game using the indoor putting game device, as shown in FIGS. 1, 5-8, the selected goal board 3 is to be placed on the rest board 13 of the main body 1 with its lower end, the position pins 14 are fitted in one pair of the position holes in the two sidewalls of the main body 1 in an adjusted inclined angle, with the ball course member 2 pulled out forward from the second sloped board 17 to a proper distance so as to make a virtual ball course. Then a user or player can putt a ball with a golf club on the ball course member 2, forcing the ball to roll on the ball course member 2, the second sloped board 17, the first sloped board 15 and then on the goal board 3 and into one of ball holes 31 thereon. As the inclined angle of the goal board 3 with the difference of the ball holes can be adjusted, a user has to exert different force in putting a ball to overcome the different inclination of the goal board 3. Then whether the ball falls in the ball hole 31 not, the ball 31 may roll along the stop board 12 or along the sloped board 15 and then out of the exit 16 at the front portion of the main body 1.

If a user finishes playing with the indoor putting game device, he can wind the handle 111 of the shaft 11 to wind the extended ball course member 2 back onto the shaft 11.

As can be understood from the aforesaid description, the indoor putting game device according to the invention has the following advantages, compared with the conventional one mentioned above:

1. The handle of the shaft extending out of the main body enables the ball course member extended out to be wound back onto the shaft during the time not used, so the device is convenient to use and store away.

2. The device has plural goal boards to be optionally used to diversify playing modes in addition to the angle of the goal boards being adjustable to change the extent of playing interest, achieving both game and exercise at the same time.

While the preferred embodiment of the invention has been described above, it will be recognized and understood that various modifications may be made therein and the appended claims are intended to cover all such modifications that may fall within the spirit and scope of the invention.

What is claimed is:

1. An indoor putting game device comprising a main body;

a plurality of goal boards selectively mounted on said main body, each of said plurality of goal boards respectively provided with a plurality of ball holes;

a sloped board extending from a front end of said main body;

a flexible ball course member extending from said sloped board;

a rear vertical wall;

a stopping board disposed laterally in said main body and extending angularly down from said rear vertical wall;

a rest member provided laterally in a front portion of said main body for supporting a front end of a goal board, said plurality of goal boards each respectively having different patterns and ball holes of different numbers so as to be selected for changing a playing mode so that a user can play a putting game in various modes.

2. The indoor putting game device as claimed in claim 1, wherein said main body has two sidewalls, each of which respectively have a plurality of pin holes corresponding to each other for a position pin to optionally insert for supporting an upper end of said goal board whereby said goal board may be adjusted in the degree of inclination for a golf ball to roll thereon.

3. The indoor putting game device as claimed in claim 1, wherein an additional sloped board provided between said goal board and said sloped board, has a front lower end disposed on an exit for a golf ball to roll out therefrom.

* * * * *